United States Patent [19]

Randolph

[11] Patent Number: 4,897,050

[45] Date of Patent: Jan. 30, 1990

[54] METHOD AND APPARATUS FOR MAKING COAXIAL COUPLINGS

[75] Inventor: Walter J. Randolph, Saegertown, Pa.

[73] Assignee: NTT, Inc., Meadville, Pa.

[21] Appl. No.: 330,796

[22] Filed: Mar. 30, 1989

[51] Int. Cl.[4] ..... H01R 17/18

[52] U.S. Cl. ..... 439/585

[58] Field of Search ..... 439/578–585

[56] References Cited

U.S. PATENT DOCUMENTS

| | | | |
|---|---|---|---|
| 3,295,094 | 12/1966 | De Lyon et al. | 439/585 |
| 3,670,293 | 6/1972 | Farver | 439/585 |
| 4,070,751 | 1/1978 | Hogendobler et al. | 439/585 |

*Primary Examiner*—Joseph H. McGlynn

*Attorney, Agent, or Firm*—Charles L. Lovercheck; Wayne L. Lovercheck; Dale R. Lovercheck

[57] ABSTRACT

A coaxial cable coupling made up of a plug and a socket. The plug comprises a hollow shell open at its ends, which receives an insulation washer. The insulation washer receives a hollow pin having a cylindrical wall which has a flange on one end and outwardly extending protrusions which receives the washer between them and holds the washer in place. Four indentations in the cylindrical pin extending inwardly grip a conductor and thereby electrically connect the pin to an electrical line. The pin is adapted to be received in a tubular connector on a socket having a hollow shell.

20 Claims, 3 Drawing Sheets

METHOD AND APPARATUS FOR MAKING COAXIAL COUPLINGS

BACKGROUND OF THE INVENTION

This invention relates to electrical couplings and more particularly to coaxial plugs used on shielded cable, the plugs being known as "Phono Plugs" or "RCA Plugs". These types of plugs have been in use for many years and are the simplest, most cost effective way to connect shielded cable to an electronic box where RF signals are in use. The present invention relates to an improved plug and a method for terminating the signal conductor and ground shield of the cable to the plug.

It has been common practice to manufacture these plugs with a one piece outer shell that is connected to the cable shield by soldering means. It has also been common practice to use a hollow formed center pin with a hole in the end and allow the signal conductor to enter the pin and protrude from the hole. Connection of conductor to pin is accomplished by soldering the hole which provides electrical connection. The outer diameter of the pin is 0.125" industry standard. The outer shell has an inner diameter of 0.328 which is industry standard. This method of attachment is labor intensive, requires operator skill and does not provide the appearance of quality required by the industry. It also has quality problems associated with ineffective soldering methods.

OBJECTS OF THE INVENTION

Accordingly, an object of the present invention is to provide an improved coaxial coupling and method of manufacture which provides considerable savings in time and therefore reduction in cost. A soldering attachment has been the industries standard for forty (40) years.

Another object of the present invention is to provide an additional center insulation washer with the shell which prevents loose braid wires from contacting the center pin forming a short circuit.

Another object of the present invention is to provide a plug having no hole in its center pin. This provides a better appearance and a more uniform contact point.

Another object of the present invention is to provide a four point contact which captures the wire at 90° intervals. The large size opening in the pin allows the use of a draw pin in manufacture with considerably larger openings compared to the size of the wire being attached.

Another object of the present invention is to provide a connector that is superior over the connectors of the prior art.

Another object of the present invention is to provide a coaxial coupling with improved pin on contact and sleeve portions formed by stamping and drawing operations.

Another object of the present invention is to provide an improved coaxial coupling with an improved simplified method and means for attaching wires to the couplings.

Another object of the present invention is to provide a more easily manufactured as well as a more efficient and long lived coaxial coupling.

Other and further objects of the invention will become apparent upon an understanding of the illustrative embodiments about to be described, or will be indicated in the appended claims, and various advantages not referred to herein will occur to one skilled in the art upon employment of the invention in practice.

DETAILED DESCRIPTION OF THE INVENTION

Figure 1:
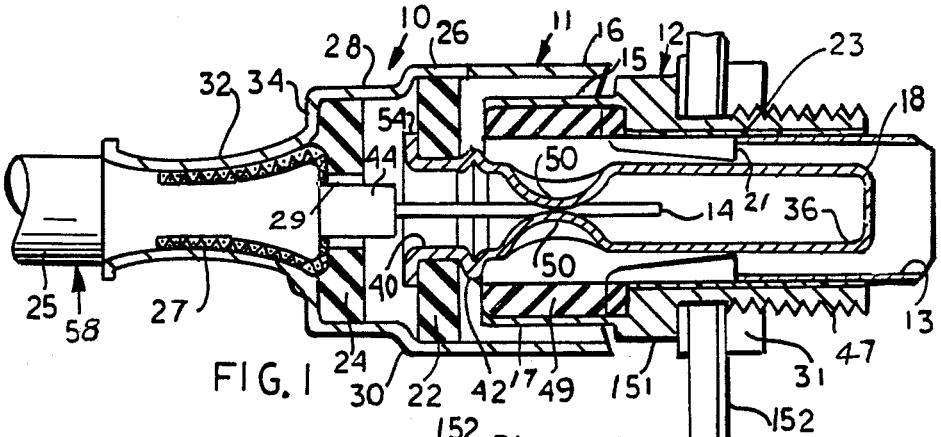
FIG. 1 is a longitudinal cross sectional view of a cable coupling, which may be a phonograph jack, in accordance with the present invention.
Figure 2:
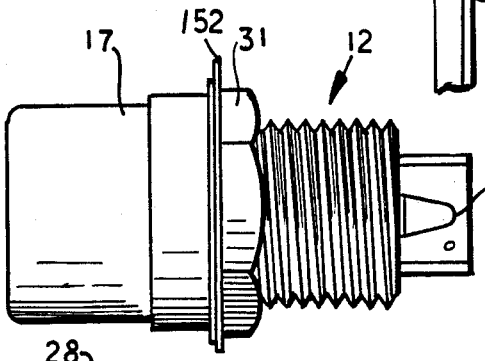
FIG. 2 is a side view of the socket of the coupling shown in FIG. 1.
Figure 3:
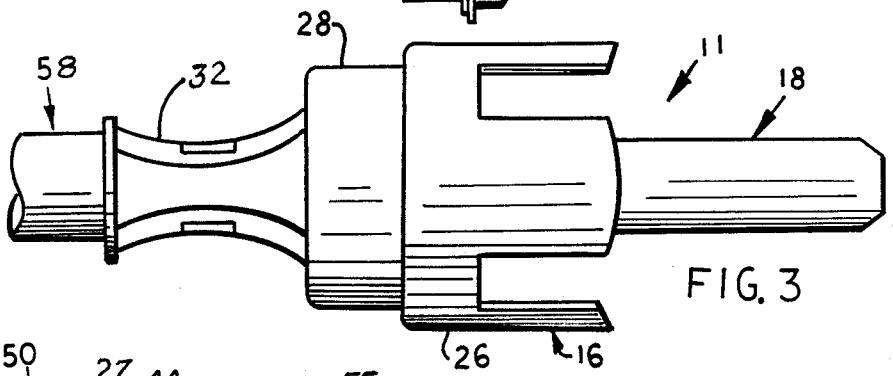
FIG. 3 is a side view of the plug of the coupling shown in FIG. 1.
Figure 3A:
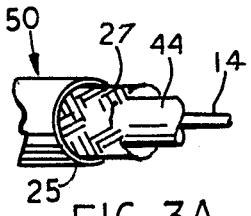
FIG. 3*a* is an enlarged isometric view of a coaxial cable.
Figure 4:
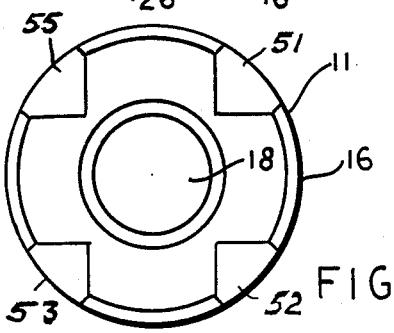
FIG. 4 is an end view of the plug shown in FIG. 3.
Figure 5:
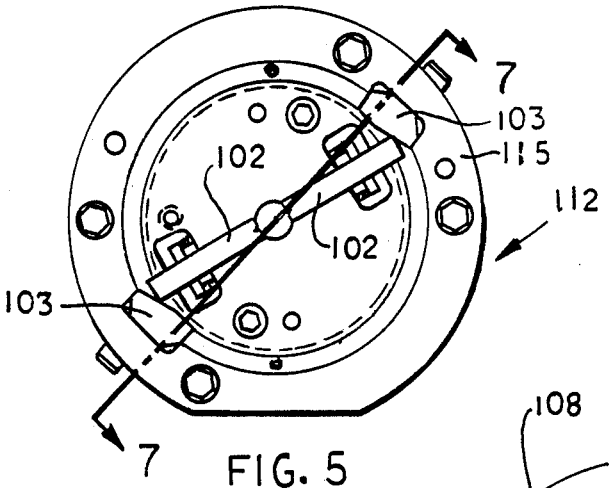
FIG. 5 is a front view of a crimp head assembly for use on an automatic machine assembly for making the coupling.
Figure 10:
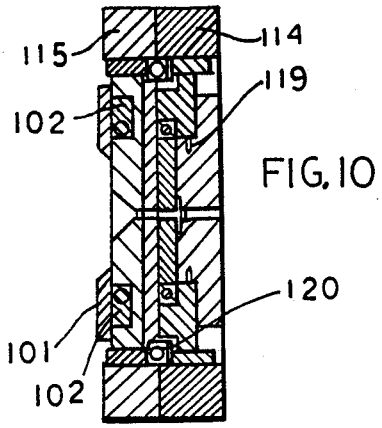
FIG. 10 is a cross sectional view taken on line 8—8 of FIG. 6.

Now with more particular reference to the drawings, a coupling 10 is disclosed in FIGS. 1 through 4 which connects coaxial cable 58 and an electronic device by means of a detachable connection between plug 11 and socket 12 which comprise an improved connection for a phono plug socket. A mounting wall 152, which may be the chassis of a TV, VCR, phonograph or the like, may support socket 12 by means of nut 31. Hollow, generally cylindrical plug 11 may be supported in socket 12. Both plug 11 and socket 12 may be made of brass, aluminum or other suitable material. Plug 11 may be used with socket 12 for connecting first electrical conductor 14 to electrical conductor sleeve 13.

Socket 12 is made up of hollow cylindrical sleeve 17 having an open end which receives first insulation sleeve 49. Second insulation sleeve 23 is concentrically disposed in hollow threaded end 47 of hollow cylindrical sleeve 17. Shoulder 151 is formed on sleeve 17 at an intermediate part and shoulder 151 provides a stop which rests against mounting wall 152. Electrical conductor sleeve 13 is disposed inside second insulation sleeve 23 and forms a conductor to be electrically connected to an electrical device.

When plug 11 is received in socket 12, as shown in FIG. 1, a first electrical circuit is formed from first conductor 14 through indentations 50 to pin 18. Generally cylindrical first end 36, of pin 18, is adapted to be received in electrical conductor sleeve 13 of socket 12, which has circumferentially spaced axially directed socket contacts 21 which engage the outer periphery of pin 18.

A second electrical circuit is formed when wire shield 27 is connected to third part 32 of shell 16, through inwardly directed plug contacts 15 to hollow cylindrical sleeve 17 and from hollow cylindrical sleeve 17 to mounting wall 152. Thus wire shield 27 is connected to mounting wall 152 and insulated by first insulation sleeve 23 and second insulation sleeve 49 from the first electrical circuit.

Coaxial cable 58 is of a type well known to those skilled in the art, and may be made up of electrical first conductor 14 with insulation 44, wire shield 27 and cover 25. Wire shield 27, typically made of fine strands of wire, is disposed around insulation 44 and cover 25 is disposed around wire shield 27.

When installed in plug 11, cover 25 is removed back to annular second flange 34. Wire shield 27 is then turned back over cover 25 and second insulation washer 24 is pressed into cylindrical reduced size second part 28 against annular second flange 34. Reduced size third part 32 is then deformed into engagement with the turned back end of wire shield 27. It will be noted that opening 29, through second insulation washer 24, is substantially larger than insulation 44 so that first conductor 14 is totally supported by indentations 50 on pin 18.

Plug 11 is generally made up of hollow cylindrical shell 16, pin 18, first insulation washer 22 and second insulation washer 24. Shell 16 has hollow cylindrical first part 26, hollow generally cylindrical second part 28 and hollow generally cylindrical third part 32. First part 26, of shell 16, is of slightly larger diameter than second part 28 and third part 32 is of slightly smaller diameter than second part 28. First part 26 is integrally connected to second part 28 at first flange 30. Second part 28 is integrally connected to third part 32 by annular second flange 34. After coaxial cable 58 is in place, third part 32 is deformed into a generally hourglass shape into clamping engagement with cover 25. First insulation washer 22 is received in first part 26 and rests on first flange 30. Crimp flange 42 and mounting flange 54 receive first insulation washer 22 between them and hold pin 18 in place on first insulation washer 22.

Figure 6:
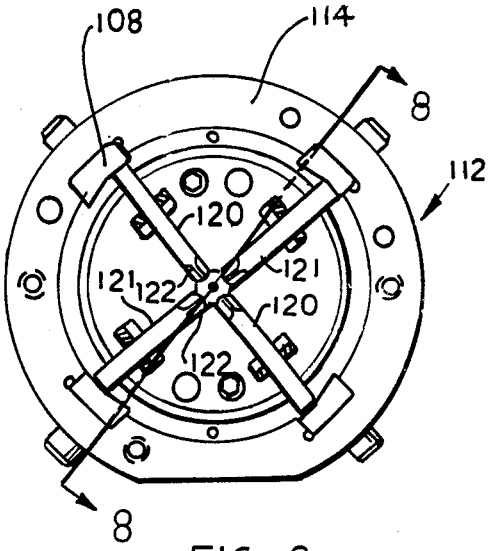
FIG. 6 is a rear view of the assembly shown in FIG. 5.
Figure 7:
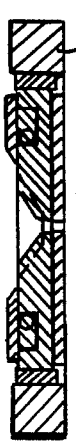
FIG. 7 is a partial cross sectional view taken on line 7—7 of FIG. 5.
Figure 8:
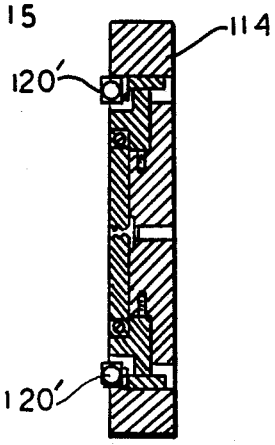
FIG. 8 is a partial cross sectional view taken on line 8—8 of FIG. 6.
Figure 9:
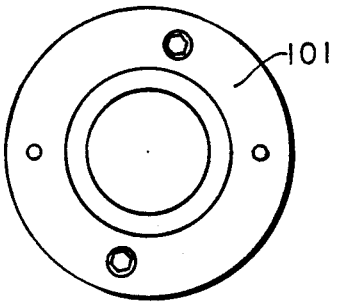
FIG. 9 is a front view of the part shown in FIG. 10.

Four indentations 50 can be formed by four radially extending tools 120 on machine 110, shown in FIG. 6, which may enter slots 51, 52, 53 and 55 engage pin 18 and form indentations 50 in pin 18, holding conductor 14 centered in pin 18. Springs 119 urge tools 122 radially outwardly.

Second insulation washer 24 is received in second part 28 of shell 16 and engages annular second flange 34 and wire shield 27. Second insulation washer 24 may have a snug fit in second part 28. Thus coaxial cable 58 is supported concentric to shell 16 by second insulation washer 24.

The end of pin 18 remote from mounting flange 54 is closed. This closed end provides a better appearance than an open hole in similar pins of the prior art. The electrical connections of the plug itself avoids the use of solder connections and avoids active flux with their attendent problems of corrosive residue which are extremely difficult to remove. Also, second insulation washer 24, inside shell 16, prevents loose shield wires from contacting pin 18 and causing short circuits. Support means 40 of pin 18 is received in and is supported by first insulation washer 22.

Figure 12:
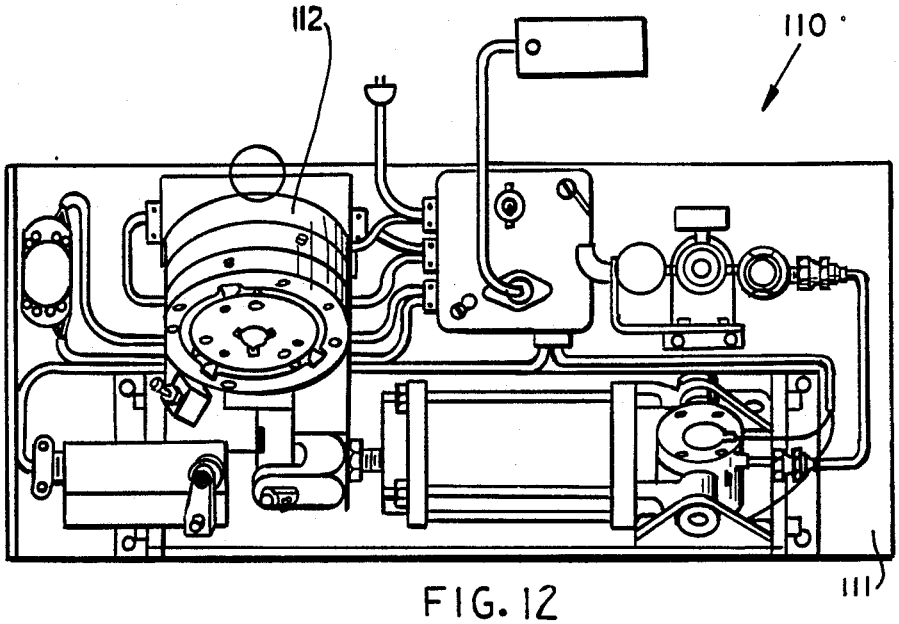
FIG. 12 is a top view of the automatic crimp machine.
Figure 11:
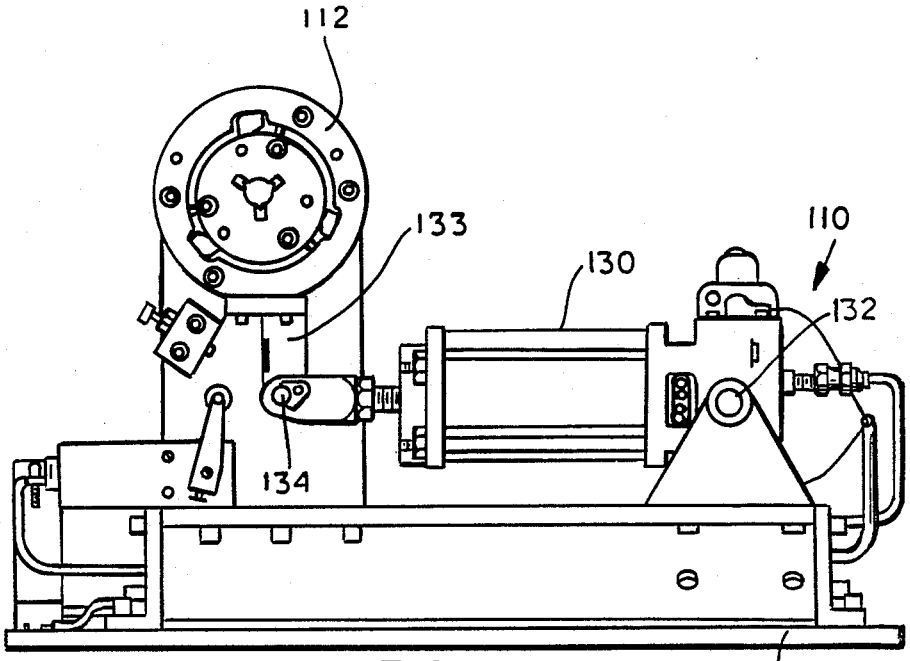
FIG. 11 is a front view of the automatic crimp machine.

In FIGS. 11 and 12 a machine, generally indicated at 110, is shown by way of example, which could be used for automatically forming shell 16 and pin 18. Machine 110 has base 111. Front crimp tool block 112 is made up of back cam ring 114 and front cam ring 115 which are rotated relative to one another with keeper plate 101 supported on front crimp tool block 112. Front cam ring 115 and back cam ring 114 are rotatably supported relative to each other by means of bearings 120'. Crimp jaws 102 are radially slidable on front crimp tool block 112. Front cam blocks 103 are fixed to front cam ring 115. Keeper plate 101 allows crimp jaw 102 to move in and out radially of front cam ring 115.

Back crimp tool block 107 is supported on back cam ring 114 and is rotatable thereon. Back cam blocks 108 are supported on back cam ring 114 and engage the outer ends of pin cam jaw members 120 and 121.

It will be seen that hydraulic cylinder 130, which is pivotally supported on machine 110 at position 132 and connected to arm 133 at position 134, will rotate back cam ring 114 relative to front cam ring 115. Blocks 108 move with back cam ring 114 and tools 122 are moved by arms 133 and pin crimp jaws 120 and 121 are moved toward each other forming indentations 50 on pin 18.

The foregoing specification sets forth the invention in its preferred, practical forms but the structure shown is capable of modification within a range of equivalents without departing from the invention which is to be understood is broadly novel as is commensurate with the appended claims.

The embodiments of the invention in which an exclusive property or privilege is claimed are defined as follows:

1. A plug for connecting a coaxial cable to a socket comprising:

a hollow cylindrical shell having a first open end, a second open end, a first part, a second part and a third part, said second part being disposed between said first part and said third part, a hollow cylindrical pin having an open end, said hollow cylindrical pin being disposed in said hollow cylindrical shell and concentric thereto, a first insulation washer in said first part, said coaxial cable having a first conductor, insulation over said first conductor and a wire shield over said insulation, flange means holding said pin in place on said first insulation washer and connecting said pin to said first conductor, said shell being adapted to receive said coaxial cable, said first conductor being adapted to extend into said pin, said third part of said shell being deformed into engagement with said wire shield forming electrical and mechanical connection with said wire shield.

2. The plug recited in claim 1 wherein said flange means comprises indentations on said pin for engaging said first conductor, thereby making electrical contact therewith and holding said first conductor in place on said pin.

3. The plug recited in claim 2 wherein said shell has circumferentially spaced slots in said first part for receiving tools for forming said indentations on said pin.

4. The plug recited in claim 1 wherein said pin has a closed end opposite said open end.

5. The plug recited in claim 1 wherein said third part of said shell is of smaller diameter than said first part, said wire shield is turned back over a cover and said third part is adapted to be deformed into engagement with said wire shield making electrical contact therewith and holding said coaxial cable in place in said shell.

6. In combination a plug and a socket for connecting a coaxial cable to an electrical first conductor comprising:

said coaxial cable having a first electrical conductor, insulation over said first electrical conductor and a wire shield over said insulation, said plug comprising a hollow shell and a hollow pin, said hollow pin being concentrically received in said shell, said shell having a first part, a second part and a third part, said third part receiving said coaxial cable and said third part being deformed inwardly into engagement with said wire shield whereby said coaxial cable is supported in said shell, said hollow pin being deformed inwardly into engagement with said first conductor whereby said first conductor and said hollow pin are connected together, said first part of said shell receiving said socket.

7. The combination recited in claim 6 wherein said socket has a hollow cylindrical sleeve received in said first part of said shell of said plug, inwardly extending electrical plug contact means for connecting said hollow cylindrical sleeve of said socket to said shell, an electrical conductor sleeve in said hollow cylindrical sleeve and an insulation means between said electrical conductor sleeve and said hollow cylindrical sleeve and inwardly extending socket contacts on said electrical conductor sleeve making electrical contact with said hollow pin.

8. A method of assembling an electrical plug on a coaxial cable comprising providing:

a hollow generally cylindrical shell, inserting a first insulation washer into said shell, inserting a hollow pin, having an open end, into said first insulation washer, providing a first conductor having an end, insulation over said first conductor, wire shield over said insulation and a cover over said wire shield, bending an end of said wire shield back over said cover, stripping said insulation from an end of said first conductor thereby exposing said end of said first conductor, inserting said first conductor into said pin with said end of said wire shield in said end of said shell, forming indentations in said pin to engage said first conductor forming an electrical connection thereby supporting said first conductor in said pin.

9. The method recited in claim 8 wherein including engaging said shell with tools whereby said shell is deformed into engagement with said wire shield.

10. The method recited in claim 8 wherein said shell has a plurality of axially disposed slots and said tools are inserted through said slots engaging said pin forming said indentations.

11. The method recited in claim 8 wherein said hollow pin has a closed end and an open end and said first conductor is inserted into said open end of said pin.

12. The method recited in claim 8 wherein a second insulation washer is inserted in said shell and, said wire shield engages said second insulation washer whereby said coaxial cable is held in position in said shell.

13. The method recited in claim 8 wherein a supporting means is formed on said pin, said supporting means comprising an outwardly directed mounting flange, said mounting flange is formed on said pin adjacent said first insulation washer, a crimp flange is formed on said pin spaced from said mounting flange, said mounting flange and said crimp flange hold said pin in position in said shell.

14. The method recited in claim 8 wherein said first insulation washer has an outer periphery disposed in engagement with said shell whereby said pin is held in spaced relation to said shell.

15. The method recited in claim 8 wherein said second insulation washer has an outer periphery disposed in engagement with the inside surface of said shell whereby said insulation is held generally concentric to said shell.

16. The method recited in claim 8 wherein said pin is adapted to be inserted into an open end of a socket, said socket having inwardly directed socket contacts for engaging said pin for making electrical contact therewith.

17. A plug for use with a socket for connecting a shielded electrical first conductor to an electrical second conductor comprising:

said first conductor having insulation, a wire shield and a cover over said wire shield, a hollow, generally cylindrical shell, a hollow, generally cylindrical pin, a circular first insulation washer with a first hole therethrough and a circular second insulation washer with a second hole therethrough, said shell having a generally cylindrical first part, a generally cylindrical second part and a generally cylindrical third part, said second part being of smaller diameter than said first part and of larger diameter than said third part, said second part being connected to said first part by an outwardly directed first flange and connected to said third part by an inwardly directed annular second flange, said first insulation washer being supported in said first cylindrical part and resting on said first flange, said second insulation washer being disposed in said second cylindrical part of said shell in spaced relation to said first insulation washer and in engagement with said annular second flange, said pin extending through said first hole in said first insulation washer, a crimp flange and a mounting flange on said pin supporting said pin in said first insulation washer whereby said pin is supported in spaced concentric relation to said shell, indentations on said pin supporting said first conductor on said pin and making electrical connection therewith, said third part engages with wire shield forming electrical and mechanical contact therewith whereby said wire shield is held in position in said shell.

18. The plug recited in claim 17 wherein said crimp flange is spaced from said mounting flange with said first insulation washer disposed between said crimp flange and said mounting flange, said mounting flange and said crimp flange engaging said first insulation washer.

19. The plug recited in claim 18 wherein said third part of said shell is generally hourglass shaped, said third part receives said wire shield and engages said wire shield providing contact between said wire shield and said shell.

20. The plug recited in claim 19 wherein said first part of said shell has at least four axially directed slots formed therein to receive said tools for forming said indentations.

* * * * *